US006024616A

United States Patent [19]

Takayanagi

[11] Patent Number: 6,024,616

[45] Date of Patent: Feb. 15, 2000

[54] ENGINE COVER OF OUTBOARD MOTOR

[75] Inventor: Masashi Takayanagi, Hamamatsu, Japan

[73] Assignee: Suzuki Kabushiki Kaisha, Hamamatsu, Japan

[21] Appl. No.: 09/150,700

[22] Filed: Sep. 10, 1998

[30] Foreign Application Priority Data

Sep. 11, 1997 [JP] Japan ..... 9-247236

[51] Int. Cl.[7] ..... B63H 20/32

[52] U.S. Cl. ..... 440/77; 440/900; 123/198 E

[58] Field of Search ..... 440/76, 77, 88, 440/900; 123/195 P, 184.21, 198 E

[56] References Cited

U.S. PATENT DOCUMENTS 5,195,483 3/1993 Ishida ..... 440/77

5,899,778 5/1999 Hiraoka et al. ..... 440/77

FOREIGN PATENT DOCUMENTS 7-91276 4/1995 Japan .

*Primary Examiner*—Stephen Avila

*Attorney, Agent, or Firm*—Finnegan, Henderson, Farabow, Garrett & Dunner, L.L.P.

[57] ABSTRACT

An outboard motor includes an engine which is covered by an engine cover which is formed with a cylindrical air suction port having an opening opened to an upper surface of the engine cover in a state of the outboard motor mounted to a hull, and a portion of an opening area of the opening is covered by a lid member which is formed to a rear edge portion of the opening.

4 Claims, 4 Drawing Sheets

ENGINE COVER OF OUTBOARD MOTOR

BACKGROUND OF THE INVENTION

The present invention relates to an engine cover of an outboard motor.

An engine of an outboard motor is generally covered by an engine cover, and an air intake port for introducing an air in an engine room is formed at a rear upper portion of the engine cover.

The air intake port is provided inside with an air suction port in shape of chimney as shown in Japanese Patent Laid-open (KOKAI) Publication No. HEI 7-91276. However, since the chimney-shaped suction port has an upper surface entirely opened, there is a fear such that water introduced through an opening portion of the engine cover may be invaded into the engine room.

In another prior art example, there is provided a structure having an air suction port formed in a duct-shape. Such structure is however made complicated and requires much manufacturing cost, and in an adverse case, air suction amount may be reduced, thus being inconvenient.

SUMMARY OF THE INVENTION

An object of the present invention is to substantially eliminate defects or drawbacks encountered in the prior art mentioned above and to provide an engine cover of an outboard motor having a structure capable of preventing water from invading into an engine room without reducing the air suction amount.

This and other objects can be achieved according to the present invention by providing an engine cover of an outboard motor having an engine which is covered by an engine cover, the engine cover being formed with a cylindrical air suction port having an opening opened to an upper surface of the engine cover in a state of the outboard motor mounted to a hull, wherein a portion of an opening area of the opening is covered by a lid member which is formed to a rear edge portion of the opening.

In a preferred embodiment, a rib is formed to an upper surface of the lid member so as to project upward. The lid member is located at a level higher than a location of a front edge portion of the opening.

A tilt-up handle is disposed above the air suction port and the tilt-up handle is formed with an air intake port through which an air is introduced towards the air suction port.

According to the structure of the engine cover of the outboard motor mentioned above, since a portion of the opening formed to the air suction port of the engine cover is covered by the lid member, water mixed with an air introduced into the engine from the air intake port disposed at a rear portion of the tilt-up handle can be substantially prevented from invading into the engine room, whereby the durability and the reliance of the engine can be improved.

Furthermore, since the lid member is positioned at a level higher than the front edge portion of the opening of the air suction port, an area between the back surface of the tilt-up handle and the opening of the suction port can be made relatively wide, so that sufficient amount of suction air can be ensured even where a portion of the opening is covered by the lid member.

Still furthermore, the formation of the rib projecting upward from the upper surface of the lid member can be further prevent the water from invading into the engine room without reducing the intake air amount.

The nature and further characteristic features of the present invention will be made more clear from the following descriptions made with reference to the accompanying drawings.

DESCRIPTION OF THE PREFERRED EMBODIMENT

Figure 1:
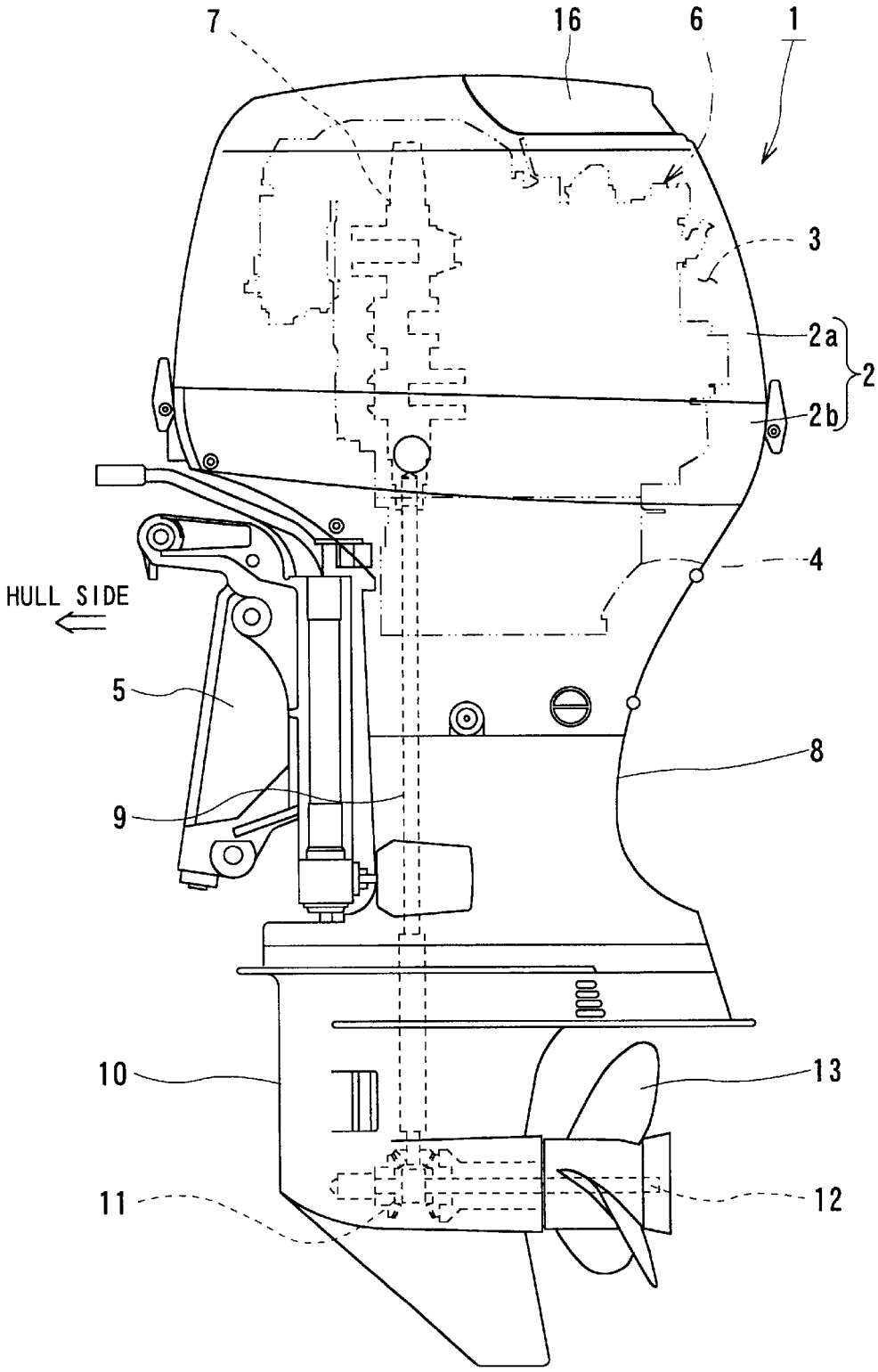
FIG. 1 is a left side view of an outboard motor in a state mounted to a hull, for example, having an engine cover according to the present invention.
Figure 2:
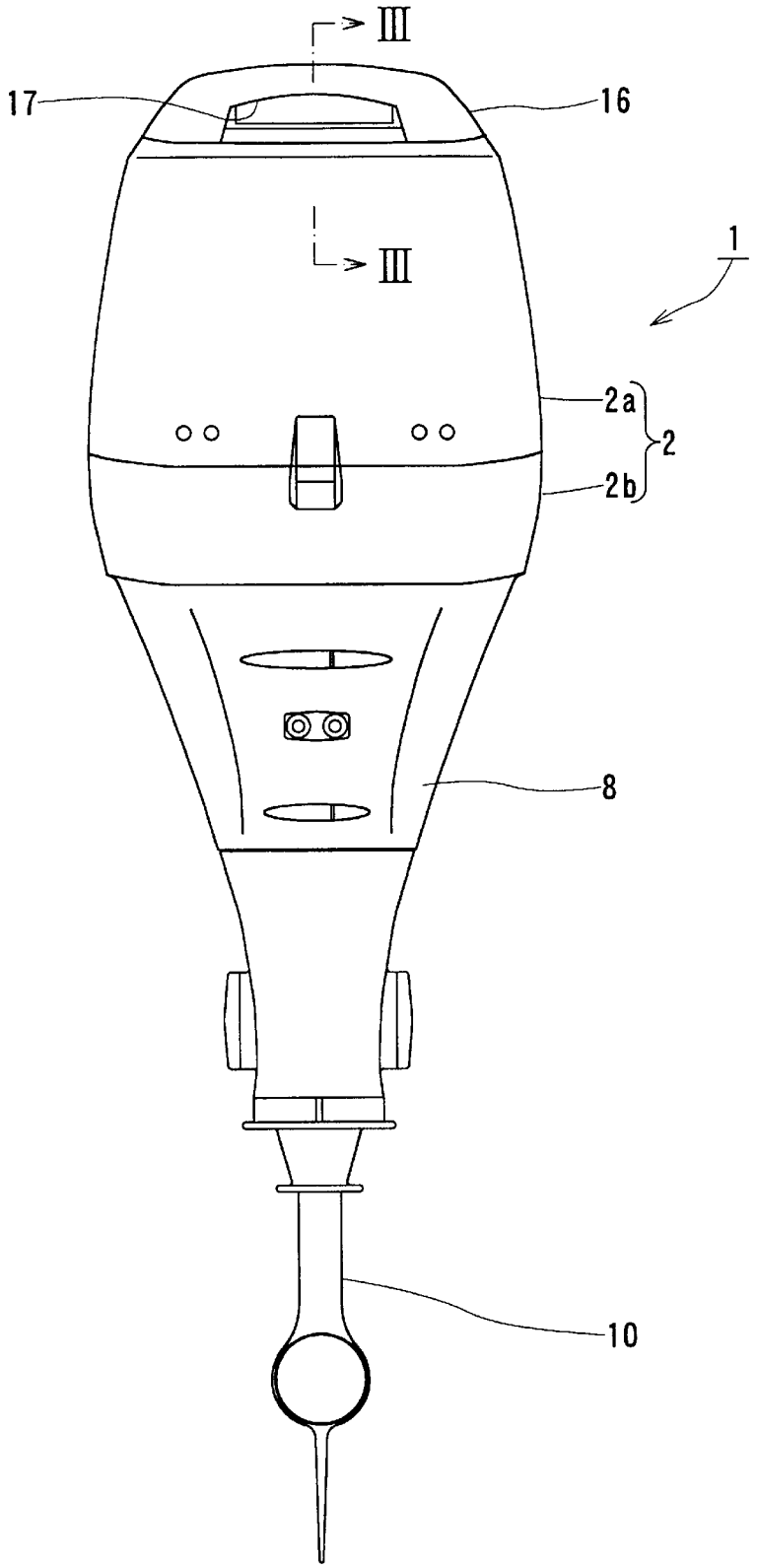
FIG. 2 is a rear side view of the outboard motor of FIG. 1.

With reference to FIGS. 1 and 2 showing a preferred embodiment of the present invention, an outboard motor 1 has an upper half formed by an engine cover 2 made of a resin, for example, in which an engine room 3 accommodating an engine 6 is defined. An engine holder 4 is arranged to a lower portion inside the engine room 3. The outboard motor 1 is mounted to a hull, not shown, through a bracket 5 attached to the engine holder 4.

An engine 6 is mounted to an upper portion of the engine holder 4 and an outer peripheral portion of the engine 6 is covered by an engine cover 2, which is sectioned into two vertical sections of an upper cover section 2*a* covering the upper portion of the engine 6 and a lower cover section 2*b* covering the engine holder 4 and the lower portion of the engine 6.

A crankshaft 7 is provided in the engine 6 so as to extend vertically therein and has a lower end portion to which a drive shaft 9 is coupled. The drive shaft 9 is disposed so as to extend downward in a drive shaft housing 8 arranged below the engine holder 4. The rotation of the drive shaft 9 is transmitted to a bevel gear 11 and a propeller shaft 12 in a gear case 10 disposed to the lower portion of the drive shaft housing 8, through which a propeller 13 is driven and rotated.

Figure 3:
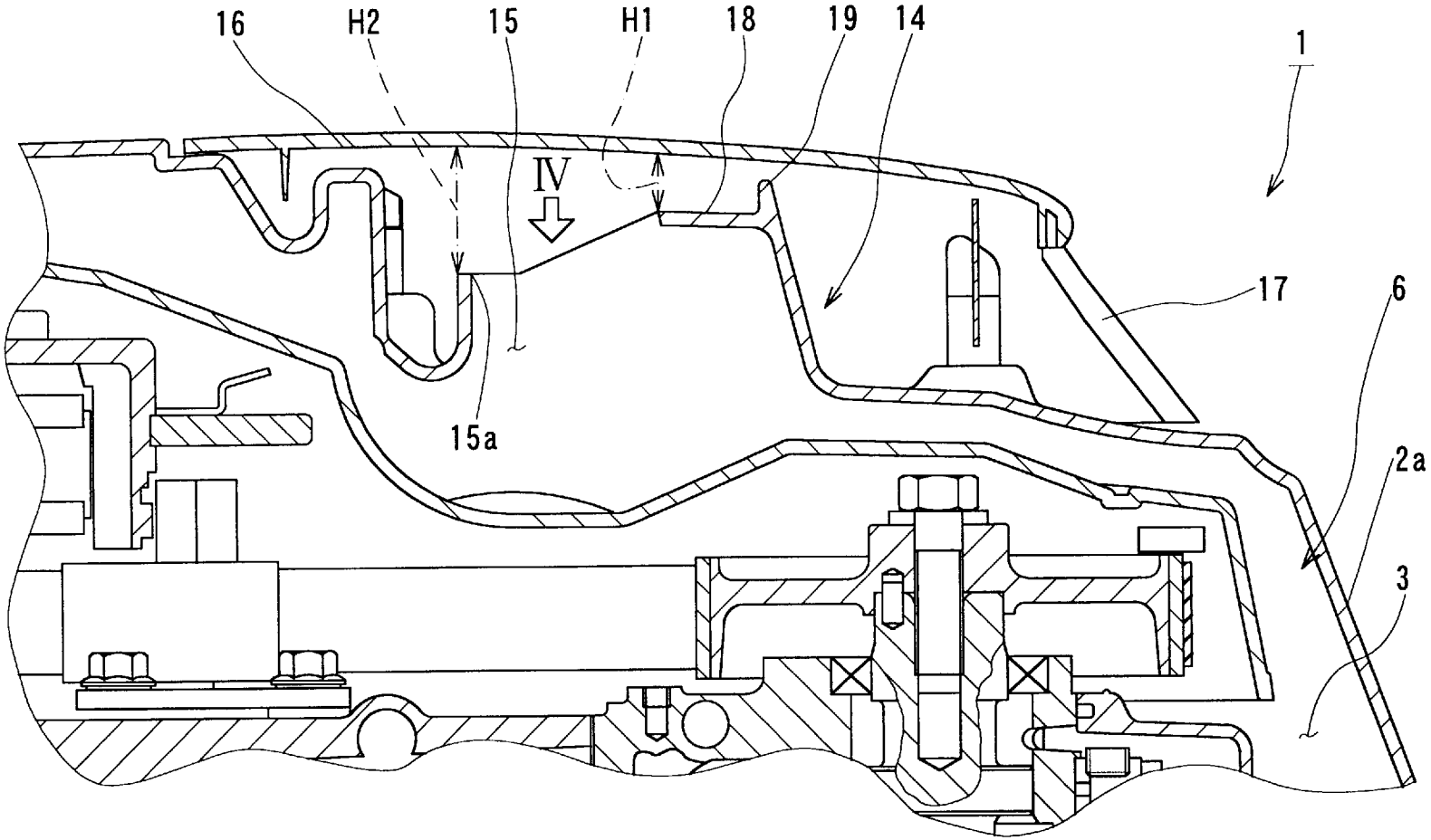
FIG. 3 is a sectional view taken along the line III—III in FIG. 2.
Figure 4:
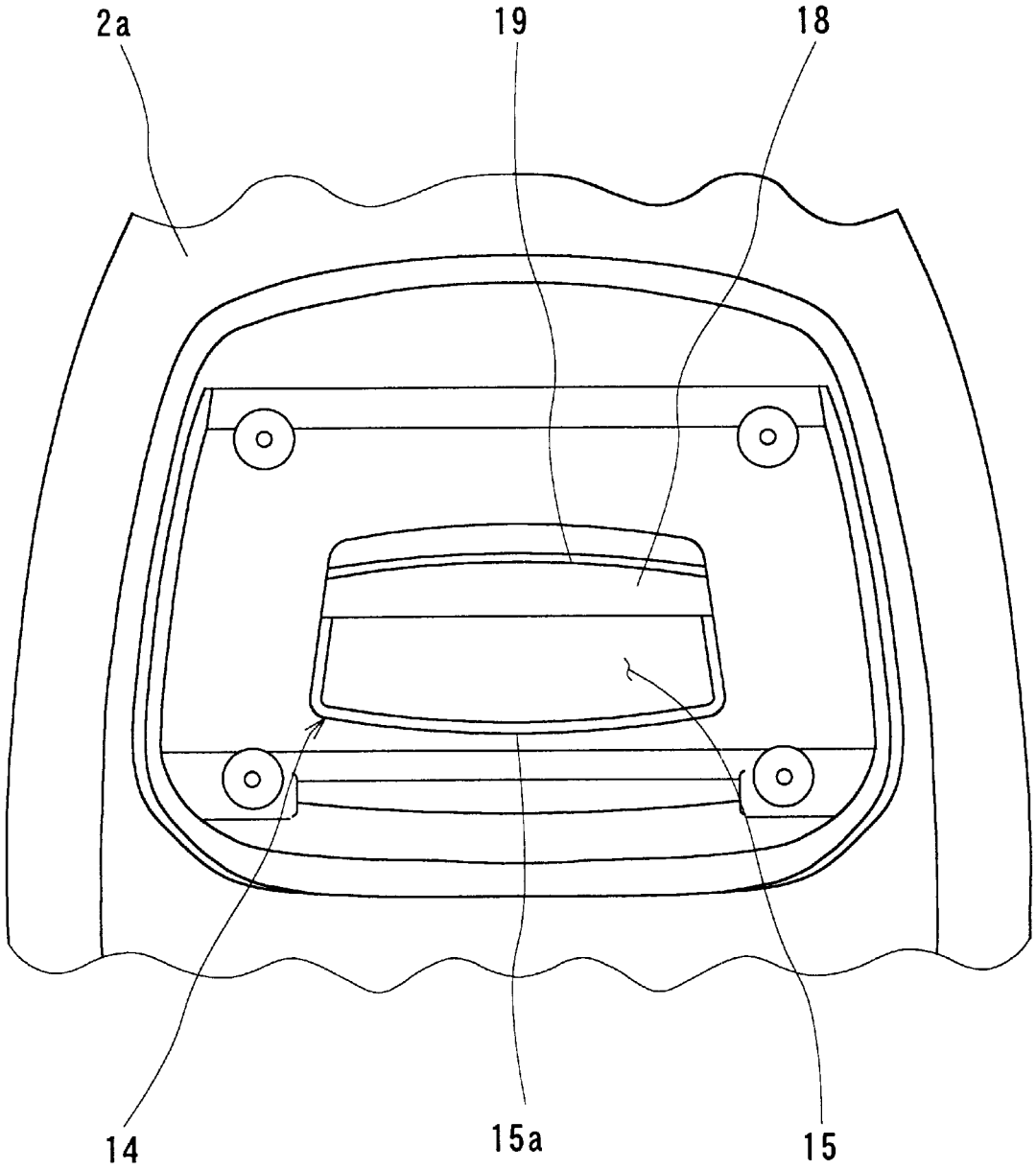
FIG. 4 is a plan view of a portion shown by an arrow IV in FIG. 3 and its surrounding portion.

With reference further to FIGS. 3 and 4, an air suction port 14 is formed to an rear upper portion of the engine cover 2 (right upper portion in FIG. 1) for taking an air into the engine room 3 from the outside of the outboard motor 1. The air suction port 14 has a cylindrical structure provided with an opening 15 formed to the upper end portion thereof. A tilt-up handle 16 for tilting upward the outboard motor 1 is disposed above the air suction port 14. An air intake port 17 is formed to the rear portion of the tilt-up handle 16 so as to be opened outward, through which an air is taken in and then guided into the engine room 3 through the air suction port 14. Further, it is to be noted that the word "front" used herein means a hull side when the outboard motor 1 is mounted to the hull and the word "upper" or the like used herein is a position in a state of the outboard motor mounted to a hull.

A portion of the opening 15 formed to the upper end of the air suction port 14 is covered by a lid member 18, that is, for example, in FIG. 3, about ⅓ area of the opening 15 from a rear edge portion thereof. The lid member 18 is positioned at a level higher than the location of a front edge portion 15*a* of the opening 15.

That is, for example, as shown in FIG. 3, a distance H1 between a back surface of the tilt-up handle 16 and the lid member 18 and a distance H2 between the back surface of the tilt-up handle 16 and the front edge portion 15*a* of the opening 15 are set so as to provide a relationship of H1>H2.

A rib 19 is further formed integrally to the upper surface of the lid member 18 so as to project upward therefrom.

According to the structure of the engine cover of the outboard motor of the present invention mentioned above, since a portion of the opening 15 formed to the air suction port 14 is covered by the lid member 18, water mixed with an air introduced into the engine from the air intake port 17 disposed at a rear portion of the tilt-up handle 16 can be substantially prevented from invading into the engine room 3, whereby the durability and the reliance of the engine can be improved.

Furthermore, since the lid member 18 is positioned at a level higher than the front edge portion 15*a* of the opening 15 of the air suction port 14, an area between the back surface of the tilt-up handle 16 and the opening 15 of the suction port 14 can be made relatively wide, so that sufficient amount of suction air can be ensured even where a portion of the opening 15 is covered the lid member 14.

Still furthermore, the formation of the rib 19 projecting upward from the upper surface of the lid member 18 can be further prevent the water from invading into the engine room 3 without reducing the intake air amount.

As mentioned above, according to the present invention, water taken in together with air can be effectively prevented from invading into the engine room without substantially reducing the intake air amount.

What is claimed is:

1. An engine cover for covering an outboard motor, said engine cover including a cylindrical air suction port having an opening opened to an upper surface of the engine cover when the outboard motor is mounted to a hull, wherein a portion of an opening area of the opening is covered by a lid member on a rear edge portion of the opening.

2. An engine cover for covering an outboard motor according to claim 1, further comprising a rib on an upper surface of the lid member, wherein the rib projects upwardly from the upper surface.

3. An engine cover for covering an outboard motor according to claim 1, wherein said lid member is located above a front edge portion of the opening.

4. An engine cover for covering an outboard motor according to claim 1, further comprising a tilt-up handle for upwardly tilting the motor, said tilt-up handle being positioned above said air suction port, wherein said tilt-up handle includes an air intake port through which air is introduced towards the air suction port.

* * * * *